US006186593B1

(12) United States Patent
Garneau

(10) Patent No.: US 6,186,593 B1
(45) Date of Patent: Feb. 13, 2001

(54) EASEL

(76) Inventor: Claude Garneau, 15607 - 100A Avenue, Edmonton, Alberta (CA), T5P 0L5

( * ) Notice: Under 35 U.S.C. 154(b), the term of this patent shall be extended for 0 days.

(21) Appl. No.: 09/246,974

(22) Filed: Feb. 9, 1999

(30) Foreign Application Priority Data

Feb. 9, 1998 (CA) ..... 2222876

(51) Int. Cl.[7] ..... A47C 7/62

(52) U.S. Cl. ..... 297/188.01; 297/188.11; 248/465; 248/464

(58) Field of Search ..... 297/4, 16.1, 183.5, 297/183.1, 188.11, 188.08, 188.01, 188.21, 217.1, 440.22, 344.1, 174; 248/460, 463, 464, 465, 441.1; D6/338

(56) References Cited

U.S. PATENT DOCUMENTS 762,512 * 6/1904 Busse .
779,202 * 1/1905 Burgess .
2,530,785 * 11/1950 Rocca .
3,117,816 * 1/1964 De Sena .
3,244,450 * 4/1966 Boutin .
4,103,965 * 8/1978 Engman .
5,308,035 * 5/1994 Ross .
5,330,248 * 7/1994 Smyly et al. .
5,547,246 * 8/1996 Lambert .

FOREIGN PATENT DOCUMENTS

670180 * 10/1964 (IT) ..... 297/174

* cited by examiner

*Primary Examiner*—Milton Nelson, Jr.
(74) *Attorney, Agent, or Firm*—Frost Brown Todd LLC

(57) ABSTRACT

A combination chair and easel is disclosed which is collapsible into a small package for easy carriage by an artist into the field. Various carriage methods could be used including the addition of handles and wheels, or the addition of backpack-type straps for carriage of the device. The deployment of such a collapsible combined chair and easel is a considerable improvement over methods and apparatus presently known in the art. Sitting on the chair which is attached to the easel also increases the stability of the easel during use.

8 Claims, 2 Drawing Sheets

EASEL

This invention is in the field of art supplies and more specifically deals with a combined chair and easel for mobile use by an artist.

BACKGROUND

Standard equipment for painters, illustrators and other artists are an easel to hold their canvas or work media and a chair. While this equipment is very simply constructed and used in a studio or an easily accessible remote location, nature artists or others who need to carry such equipment to remote locations have the problem of lugging such equipment into their work environment. In many cases such equipment is not terribly comfortable to use.

This invention deals with the problem of portability of painting equipment for artists who work in the outdoors or away from their studio, as well as providing a comfortable combined set of equipment for use indoors as well. The present invention is borne of the need to simplify and increase the comfort of painting both indoors and outdoors.

Particularly in the case of artists working outdoors in remote locations it would be preferable to provide a lightweight combined chair and easel set which could be easily transported to the location, and might also contain the various art supplies needed so that a single unit could be transported.

SUMMARY OF THE INVENTION

It is the object of the present invention to provide a self-contained chair and easel combination for use by an artist or the like which can be easily transported between locations.

It is a further object of the present invention to provide such a transportable chair and easel set which is collapsible.

The present invention, an easel, accomplishes these objects comprising a media frame with a top and bottom end; a stand having a top and ground-engaging end, the top end of said stand being pivotally attached to the bottom end of the media frame; and an adjustable chair attached to the stand, said chair including a seat; wherein the easel has an erect position which is achieved by pivoting the stand away from the media frame into a standing position and optionally pivoting the chair into a sitting position, and a transport position wherein the easel can be folded down into a compact unit for transport or storage.

Means of attaching various art media to the media frame might also be included. For example, media attachment means such as clamps adjustable along an axis extending between the top and bottom ends of the media frame, or a media rest attached near the bottom end of the media frame upon which rigid art media could be rested, could be used. It will be understood that other types of media attachment means could also be used without departing from the scope and intent of the present invention, and are thus contemplated here within.

The easel might further improved by adding a supply box. Such a supply box could contain art supplies or other materials required during use of the easel. The supply box might be mounted anywhere on the unit, such that the folding motion of the stand and the media frame are not impeded. One particular place where it is contemplated that the supply box might be mounted would be under the seat of the chair. Positioning the supply box between the seat and the media frame would provide for a convenient location.

In one embodiment, the media frame would comprise two media frame members joined together in a spaced apart parallel relationship by a plurality of media frame cross braces.

Where the ground-engaging end of the stand has a plurality of ground-engaging points, the ground-engaging end of the stand could be rendered adjustable to conform to various terrain. Such ground-engaging points might each consist of an individually extensible and adjustable foot.

In one embodiment of the invention, the stand could comprise two stand frame members joined together in a spaced apart parallel relationship by a plurality of stand cross braces, the stand frame members thus being pivotally joined to corresponding points on the media frame and the free ends of the stand frame members at one end of the stand are the ground-engaging points.

The chair of the present invention, and particularly where the stand consists of the frame arrangement outlined above, might comprise two chair members joined in parallel by the seat. Said chair members then pivotally join to corresponding points on the two stand frame members.

The seat of the chair could be cushioned to make it more comfortable in use. Such cushion might be removable for cleaning purposes.

The chair might be strengthened by adding one or more chair supports which would hold the chair in its sitting position in relation to the stand while the chair is in use in the erect position of the easel. The chair supports might be pivotally attached to the chair or the chair members at corresponding points and extend downwards from the chair towards the stand, the chair supports and the stand being adapted to provide for a number of locking positions for the chair supports in relation to the stand.

In one embodiment of the supply box, it might actually be slidably mounted between the two chair members such that it slides under the seat for storage and slides out from under the seat for access.

To add further stability and to hold up the easel when it is being used, a leg might be added and pivotally attached to the easel such that it will pivot in the opposite direction of the stand in relation to the media frame and the free end of the leg would then be a ground-engaging end. The ground-engaging end of such a leg might be also rendered adjustable to conform to various terrain.

The leg might comprise two leg members, each pivotally attached to a corresponding point on the stand frame member on the top end of the stand. These leg members might be joined at their furthest ends in an apex.

Leg retaining means could be added to hold the leg in position in relation to the stand when the easel is in its erect position. The leg retaining means might be adjustable straps or some other method or means of retaining the leg in place in relation to the stand.

It would also be necessary to hold the media frame in place in relation to the stand when the easel is in its erect position. This might be done in the case of the member/cross brace stand embodiment discussed above by adapting the media frame and joining it to the stand such that when the easel is in its erect position the media frame will engage the stand cross brace closest to the top end of the stand and, thus, be held in its erect position.

Various types of carrying hardware could also be added to assist in the carriage and movement of the easel in its folded-down transport position. These carrying hardware might include carrying handles, wheels, or a set of straps for carriage of the easel on the person of an artist or other user thereof.

While the easel of the present invention provides for an easily foldable and transportable combination of an easel and a chair for use by an artist and the like, the ease of transport is not the only advantage enjoyed by embodiments of the present invention. By attaching the chair to the easel, the stability of the easel during use is increased over the stability of an easel separate and apart from a chair.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
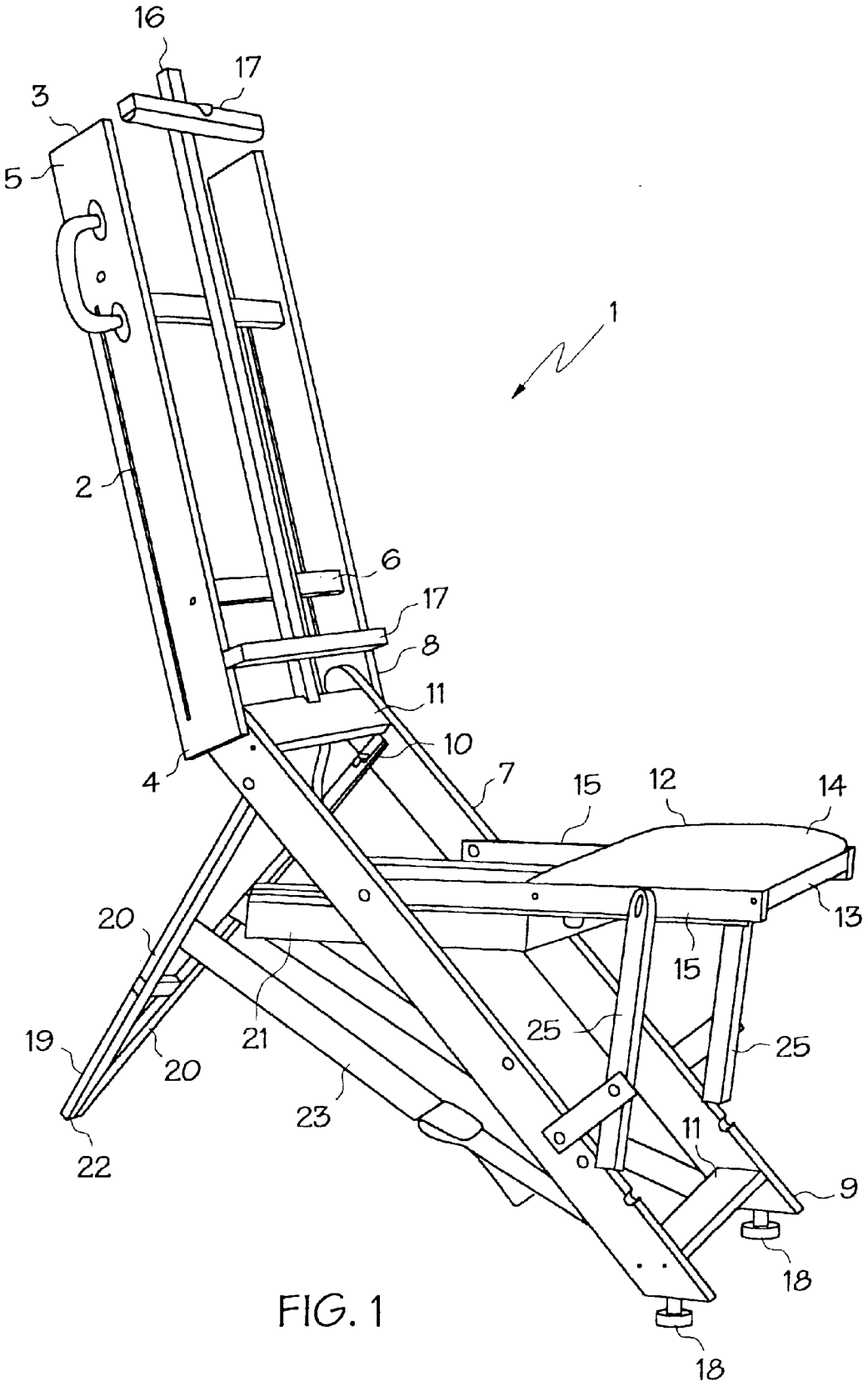
FIG. 1 is a perspective view of one embodiment of the present invention in its assembled position.

The present invention, as outlined above, is an artist's easel, which has the advantage of being a combination of an easel and a chair in an easily collapsible and transportable form. FIG. 1 shows one basic embodiment of the present invention, the basic elements of the easel (1) being a media frame (2) having a top and bottom end shown at (3) and (4), respectively; a stand (7) which has a top end (8) and a ground engaging end (9), the top end (8) of the stand being pivotally attached to the bottom end (4) of the media frame (2); and an adjustable chair (12) pivotally attached to the stand (7), said chair (12) including a seat (13). Even this most basic embodiment demonstrates the overall advantage of the present invention, which is that when the easel (1) is in an erect position, which is achieved by pivoting the stand (7) away from the media frame (2) into a standing position and optionally pivoting the chair (12) into a sitting position, and the second transport position of the easel (1) wherein the easel (1) can be folded down into a compact unit for transport or storage.

In the folded down transport position of the easel (1), the chair (12) is laid down on top of the stand (7). The media frame (2) can then be swung in and laid down on top of the chair (12) and the stand (7), yielding an approximately rectangular package for transport purposes.

In the erect position of the easel (1), the chair (12) does not necessarily need to be used. In a case where the chair (12) was left folded flat against the stand (7), the easel (1) could be used as a display easel for a piece of artwork. Also, where the chair (12) was not erected and the easel (1) was erected at its maximum height by moving the leg (19) close to the stand (7), the easel (1) could also be used as a conventional standup easel.

When mentioned in this patent, reference to attachment of items at corresponding points means that the points of attachment of the parts in question are across from each other in relation to the part to which the other items are being attached. This allows for unimpeded swinging movement.

Particularly shown in the detail of FIG. 1, the media frame (2) of the embodiment of FIG. 1 comprises two media frame members (5), which are joined together in a spaced apart parallel relationship by a plurality of media frame cross braces (6). In this particular case, two media frame cross braces (6) are shown. It will be understood that different numbers of media frame members (5) or media frame cross braces (6) could be employed or another media frame configuration altogether could be employed without departing from the scope of the present invention and, as such, it is contemplated that any such adaptation would be captured within the spirit of the claimed invention.

In the embodiment shown, by way of adjustable hardware, the media frame is slidable towards or away from the artist horizontally as well as being adjustable at its vertical angle. It will be understood that either such type of a media frame configuration is contemplated within the scope of the present invention.

The stand (7) of the easel (1) of FIG. 1 comprises two stand members joined together in a spaced apart parallel relationship by a plurality of stand cross braces (11). The stand members (10) are pivotally joined to corresponding points on the media frame (2), the free ends of the stand members (10) at one end of the stand (7) being the ground-engaging points (18). The stand cross brace (11) closest to the ground-engaging end (9) of the stand, some distance above the points (18), will prevent the stand (7) from sinking too far into soft ground or mud.

It will be understood again that various different configurations of the stand (7) are possible and, so long as they accomplish the same objective, are contemplated within the scope of the present invention.

The ground-engaging end (9) of the stand (7) might either be a flat bar or, alternatively, might consist of or include a plurality of ground-engaging points. In this particular case, the ground-engaging points of the stand (7) are shown at 18.

The ground-engaging end (9) of the stand (7) might be made adjustable in order to conform more closely to various terrain on which the easel (1) might be employed. In the case of the embodiment of FIG. 1, wherein ground-engaging end (9) of the stand (7) includes ground-engaging points (18), each of the ground-engaging points (18) can be manufactured to consist of an individually extensible and adjustable foot. This is shown in FIG. 1. Thus, to adjust the easel (1) for proper seating on uneven ground, the ground-engaging points/feet (18) can each individually be adjusted to provide the most level positioning possible of the easel (1) on the terrain.

An extensible foot might be such a thing as a threaded rod with a foot pad on the end thereof, extending adjustably through a threaded bolt or the like attached to the stand 7. It will be understood, however, that various other methods could be contemplated of making the end lengths of the stand members (10) adjustable and that all such adaptations are contemplated within the scope of the present invention.

Media attachment means (16) are also shown, whereby a canvas or other piece of art media can be attached or rested upon the easel (1) for working. The media attachment means (16) might be any number of different things. Particularly, it is contemplated that a media rest might be used, being simply a bar placed perpendicular to the axis of the media frame (2) near the bottom end (4) of the media frame, and upon which a canvas or other piece of rigid media could be rested. A more intricate method of media attachment means (16) are shown in FIG. 1 comprising two clamps (17) adjustably spaced apart along an axis extending between the top and bottom ends (3) and (4) of the media frame (2). Each of the clamps (17) is a solid member with a neoprene band attached thereto. The neoprene band compresses to hold the painting when the clamp is secured. The neoprene band also holds different shapes of canvas etc. This clamping system also holds canvasses so that the top and bottom edge are clear to paint. It will be understood that various other clamps and methods of media attachment could be contemplated and would be intended to fall within the scope of the present invention.

In the embodiment of FIG. 1, the chair (12) comprises two chair members (15), joined in parallel by the seat (13), said chair members (15) being each pivotally joined to a corresponding point on the two stand members (10). This allows for the chair (12) to pivot up and down relative to the stand (7) and lie in a position roughly parallel to the stand (7) when in transport position.

The easel (1) is further strengthened by the chair supports (25). The chair supports (25) hold the chair (12) firmly and solidly in its sitting position in relation to the stand (7) when the chair (12) is in use, while the easel (1) is in its erect position. In this case, the chair supports (25) are two in number and are pivotally attached to the chair members (15) at corresponding points and extend downwards from the chair (12) from each chair member (15) towards the stand (7), wherein the chair supports (25) and the stand (7) are adapted to provide for a number of locking positions for the chair supports (25) in relation to the stand (7). In this case, the locking positions of the chair supports (25) in relation to the stand (7) are provided by a number of notches in the edge of the stand members (10), each of which pair of corresponding notches allow the chair supports (25) to rest therein and support the chair (12) above. It will be understood that other methods could be used of securing the chair supports to the stand, such as clamps or the like, and that all such changes and necessary adaptations of the invention thereto, will be contemplated within the scope of the present invention.

The chair (12) could be further improved by the addition of a removable cushion (14) to the seat (13). This would allow for easy cleaning of the cushion (14) and would provide for better padding on the seat (13) and more comfortable use of the easel (1).

Also shown in FIG. 1 is a leg (19) pivotally attached to easel (1) such that it will pivot in the opposite direction of the stand (7) in relation to the media frame (2), the free end of said leg (19) being a ground-engaging end. The ground-engaging end of the leg (19) might be adjustable to conform also to various terrains. In the embodiment shown, the leg (19) comprises two leg members (20), each of which is pivotally attached to a corresponding point on its respective stand member (10) near the top end (8) of the stand (7). These leg members (20), in this particular case, join in an apex (22). The overall height and stability of the easel (1) can be adjusted when the easel (1) is assembled in its upright position by moving the apex (22) of the leg (19) closer to or further away from the ground-engaging end (9) of the stand (7). It will be understood again that various combinations of materials and configurations could be used for the leg (19) and that all such adaptation is contemplated within the scope of the present invention.

The stand (7) carries the majority of the weight, rather than the leg (19).

Joining the leg (19) and the stand (7) in this case is a leg retaining means (23), which holds the leg (19) in position in relation to the stand (7) when the easel (1) is in its erect position. In this particular case, the leg retaining means (23) are adjustable straps. It will be understood that various types of rigid or pliable material could be used to make the leg retaining means (23) and any such adaptation is also contemplated within the scope of the present invention.

The media frame (2) needs to be held in position in relation to the stand (7) when the easel (1) is in its erect position. In the embodiment of FIG. 1, the media frame (2) holds itself in position in relation to the stand (7) by engaging the stand cross brace (11) closest to the top end (8) of the stand (7). This is demonstrated at point 24 on the diagram.

A supply box (21) might also be added. The supply box (21) might be mounted under the seat (13) or elsewhere on the device so long as it did not impede the other operations of the easel (1). It will be understood that various modifications to the supply box (21), or other attachment points, could be added to the basic embodiments of the invention without departing from the scope of the present invention.

In the embodiment shown the supply box (21) is mounted between the chair members (15) such that it can slide out from underneath the seat (13) for use and can then be stored underneath the seat (13), the seat (13) acting as a lid for the supply box (21). A supply box (21) could also be used that did not slide out from underneath the seat (13), but that nonetheless was located between the chair (12) and the media frame (2). It will be understood that such modifications, along with the addition of any other storage receptacle that did not otherwise interfere with the folding up of the easel (1) as a whole would not depart from the scope of the claimed invention.

In this case the adjustable straps (23) double as shoulder straps for carriage of the folded up easel (1), with small changes made to the mounting hardware for the straps (23). It will be understood that other carrying hardware such as handles, wheels or the like could also be used.

When the easel (1) is set up in the painting mode, the artist can sit on the seat by straddling the seat (12), or may sit with their legs to one side. Sitting at the easel (1) allows reasonable stability of the easel (1), with this being an important factor for any artist. The canvas et al is sturdy and can be comfortably distanced from the artist.

Figure 2:
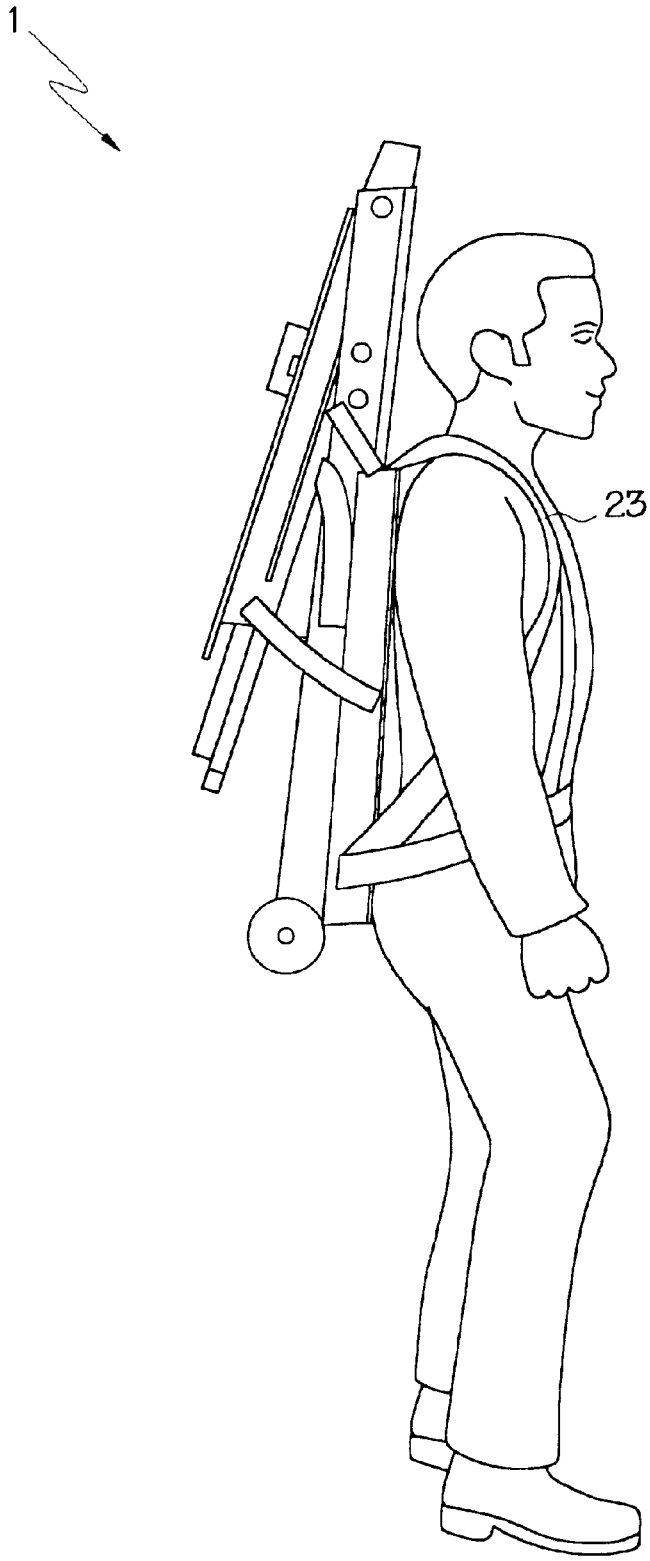
FIG. 2 is a perspective view of the embodiment of FIG. 1 collapsed into transport mode for carriage on the back of a person.

FIG. 2 demonstrates the embodiment of FIG. 1 folded up and being carried as a backpack.

Thus it can be seen that the invention accomplishes all of its stated objectives. The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

I claim:

1. An easel comprising:

a) a media frame, said media frame having a top and bottom end;

b) a stand having a top end and a ground-engaging end, the top end of said stand being pivotally attached to the bottom end of the media frame, said ground-engaging end of said stand further comprising a plurality of ground-engaging points, said stand further comprising two stand members joined together in a spaced apart parallel relationship by a plurality of stand cross-braces, said stand members being pivotally joined to corresponding points on the media frame, free ends of the stand members at one end of the stand comprising the ground-engaging points; and c) an adjustable chair pivotally attached to the stand, said chair including a seat, said chair further comprising two chair members joined in parallel by the seat, said chair members pivotally joined to corresponding points on the two stand members, wherein the easel has an erected position which is achieved by pivoting the stand away from the media frame into a standing position and optionally pivoting the chair into a sitting position, and a transport position wherein the easel can be folded down into a compact unit for transport or storage.

2. The easel of claim 1 wherein the chair further comprises two chair supports, said chair supports being pivotally attached to the chair members at corresponding points and extending downwards from the chair towards the stand, said chair supports and the stand being adapted to provide for a number of locking positions for the chair supports in relation to the stand.

3. The easel of claim 1 further comprising a supply box slidably mounted between the two chair members such that it slides under the seat for storage, and slides out from under the seat for access.

4. An easel comprising:

a) a media frame, said media frame having a top and bottom end;

b) a stand having a top end and a ground-engaging end, the top end of said stand being pivotally attached to the bottom end of the media frame, said ground-engaging end of said stand further comprising a plurality of ground-engaging points, said stand further comprising two stand members joined together in a spaced apart parallel relationship by a plurality of stand cross-braces, said stand members being pivotally joined to corresponding points on the media frame, free ends of the stand members at one end of the stand comprising the ground-engaging points, said ground-engaging end of said stand being adapted to adjust to conform to various terrain, said ground-engaging points each comprising an individually extensible and adjustable foot; and c) an adjustable chair pivotally attached to the stand, said chair including a seat, wherein the easel has an erected position which is achieved by pivoting the stand away from the media frame into a standing position and optionally pivoting the chair into a sitting position, and a transport position wherein the easel can be folded down into a compact unit for transport or storage.

5. An easel comprising:

a) a media frame, said media frame having a top and bottom end;

b) a stand having a top end and a ground-engaging end, the top end of said stand being pivotally attached to the bottom end of the media frame, said ground-engaging end of said stand further comprising a plurality of ground-engaging points, said stand further comprising two stand members joined together in a spaced apart parallel relationship by a plurality of stand cross-braces, said stand members being pivotally joined to corresponding points on the media frame, free ends of the stand members at one end of the stand comprising the ground-engaging points;

c) an adjustable chair pivotally attached to the stand, said chair including a seat; and d) a leg pivotally attached to the easel such that it will pivot in the opposite direction of the stand in relation to the media frame, a free end of said leg comprising a ground-engaging end, said ground-engaging end of said leg being adapted to adjust to conform to various terrain, said leg further comprising two leg members pivotally attached to corresponding points on the stand members near said top end of said stand, said leg members being joined at an apex at corresponding ends of said leg members most distant from said stand, wherein the easel has an erected position which is achieved by pivoting the stand away from the media frame into a standing position and optionally pivoting the chair into a sitting position, and a transport position wherein the easel can be folded down into a compact unit for transport or storage.

6. An easel comprising:

a) a media frame, said media frame having a top and bottom end;

b) a stand having a top end and a ground-engaging end, the top end of said stand being pivotally attached to the bottom end of the media frame, said ground-engaging end of said stand further comprising a plurality of ground-engaging points, said stand further comprising two stand members joined together in a spaced apart parallel relationship by a plurality of stand cross-braces, said stand members being pivotally joined to corresponding points on the media frame, free ends of the stand members at one end of the stand comprising the ground-engaging points;

c) an adjustable chair pivotally attached to the stand, said chair including a seat;

d) a leg pivotally attached to the easel such that it will pivot in the opposite direction of the stand in relation to the media frame, a free end of said leg comprising a ground-engaging end, said ground-engaging end of said leg being adapted to adjust to conform to various terrain; and e) leg retaining means adapted to hold said leg in position in relation to said stand when said easel is in its erected position, wherein the easel has an erected position which is achieved by pivoting the stand away from the media frame into a standing position and optionally pivoting the chair into a sitting position, and a transport position wherein the easel can be folded down into a compact unit for transport or storage.

7. The easel of claim 6 wherein the leg retaining means is an adjustable strap.

8. An easel comprising:

a) a media frame, said media frame having a top and bottom end;

b) a stand having a top end and a ground-engaging end, the top end of said stand being pivotally attached to the bottom end of the media frame, said ground-engaging end of said stand further comprising a plurality of ground-engaging points, said stand further comprising two stand members joined together in a spaced apart parallel relationship by a plurality of stand cross-braces, said stand members being pivotally joined to corresponding points on the media frame, free ends of the stand members at one end of the stand comprising the ground-engaging points, said media frame being held in position in relation to said stand when said easel is in its erected position by engaging said stand cross-brace closest to the top end of said stand; and c) an adjustable chair pivotally attached to the stand, said chair including a seat; wherein the easel has an erected position which is achieved by pivoting the stand away from the media frame into a standing position and optionally pivoting the chair into a sitting position, and a transport position wherein the easel can be folded down into a compact unit for transport or storage.

* * * * *